United States Patent [19]

Onomoto et al.

[11] Patent Number: 4,958,825

[45] Date of Patent: Sep. 25, 1990

[54] PAPER LET-OUT APPARATUS

[75] Inventors: Ryuichi Onomoto, Kusatsu; Masato Nishikawa, Kyoto; Masaji Ishida, Ootsu; Sachiro Arimoto, Kyoto, all of Japan

[73] Assignee: Omron Tateisi Electronics Company, Kyoto, Japan

[21] Appl. No.: 308,775

[22] Filed: Feb. 10, 1989

[30] Foreign Application Priority Data

Feb. 13, 1988 [JP] Japan ..... 63-31677

[51] Int. Cl.[5] ..... B65H 3/06

[52] U.S. Cl. ..... 271/119; 271/121; 271/149

[58] Field of Search ..... 271/119, 120, 31.1, 271/114, 121, 122, 125, 149

[56] References Cited

U.S. PATENT DOCUMENTS

| | | | |
|---|---|---|---|
| 813,810 | 2/1906 | Maynard | 271/122 |
| 1,085,781 | 2/1914 | Allen | 271/122 X |
| 3,406,627 | 10/1968 | Becker | 271/119 X |
| 3,857,559 | 12/1974 | McInerny | 271/122 |
| 4,039,181 | 8/1977 | Prewer | 271/149 X |
| 4,158,456 | 6/1979 | Holland-Letz | 271/122 X |
| 4,437,656 | 3/1984 | Onoda et al. | 271/10 |
| 4,494,747 | 1/1985 | Graef | 271/120 X |
| 4,603,847 | 8/1986 | Oota | 271/119 X |

FOREIGN PATENT DOCUMENTS

| | | |
|---|---|---|
| 2300870 | 7/1973 | Fed. Rep. of Germany . |
| 1413604 | 11/1975 | United Kingdom . |
| 2029377 | 3/1980 | United Kingdom . |

*Primary Examiner*—Richard A. Schacher

*Attorney, Agent, or Firm*—Dickstein, Shapiro & Morin

[57] ABSTRACT

A paper let-out apparatus is provided which includes a paper accommodating section for holding paper, such as bills, on a bottom plate such that the paper is inclined slightly from vertically standing state. The apparatus includes a fixed receivng plate and a pushing member for urging accommodated paper toward the receiving plate. The receiving plate is formed with a window, and a let-out roller is provided outside the paper accommodating section so that the roller faces the window. A friction member is provided to the let-out roller at a portion of the periphery thereof such that the friction member projects outwardly radially beyond the periphery thereof. As the let-out roller is driven to rotate, the friction member enters the paper accommodating section through the window to be in contact with the endmost or first paper sheet thereby letting out the same due to frictional force.

5 Claims, 4 Drawing Sheets

PAPER LET-OUT APPARATUS

BACKGROUND OF THE INVENTION

1. Field of the Invention

This invention relates generally to paper let-out or discharging apparatus, and particularly to such apparatus represented by bill let-out apparatus built in bank transaction machines such as automatic deposit and payment machines, automatic cash dispensing machines, automatic cash exchanging machines or the like.

2. Description of the Prior Art

An example of a conventional apparatus for letting-out paper or bills is shown in FIG. 7. A plurality of bills (72) are contained in superimposed condition in a bill container or inlet (bill accommodating section) 71, such that bills are slightly inclined backwardly. A main let-out roller 75 and an auxiliary roller 74 which are synchronized in rotation are arranged to be placed so that one is below the other. Bills 72 are pressed by a pushing plate 73 from the rear portion toward the front portion of the container 71, and a first bill (front or endmost bill) is in contact with these rollers 74 and 75. A separation roller 76 is in contact with the auxiliary roller 74, and a feeding roller 77 is provided thereunder.

With the front bill being let-out downwardly due to the rotation of the let-out roller 75, the discharged bill is fed to a conveying passage placed thereunder through a passage between rollers 74 and 76.

The pressing force of the pushing plate 73 is so adjusted that a contact friction force acting between the front bill and the roller 75 feeds only the single front bill. In the case of current bills, the above-mentioned contact friction force varies due to variations in humidity condition of the bills, degree of fatigue due to the difference between new and old bills, stains and surface undulations caused from printing. Such variations may cause occurrence of noneffective let-out (i.e. a bill is not let out when intended), two or more-bills discharge (two sheets of bills in layer are let-out), or jam (bills are stopped and blocked).

Thus when the let-out function or frictional force of the let-out roller 75 decreases, the pressing force by the pushing plate 73 is set to be higher than before, and on the other hand when the frictional force of the let-out roller 75 is great, the pressing force by the pushing plate 73 is decreased. However, since a greater pressing force may cause successive discharge (i.e. two or more bills are simultaneously let out), and since a smaller pressing force may cause noneffective discharge, the setting of the pressing force must be performed delicately and carefully.

The let-out roller 75 and auxiliary roller 74 are provided with friction members made of rubber or the like having a high friction coefficient on the peripheral surface thereof. Since suitable control for accurately stopping the friction member at a predetermined rotational angular position is not performed in the conventional apparatus, there is a tendency that a subsequent bill may be subjected to jamming as it is caught by the friction member or the subsequent bill is also let-out together with the front bill depending on the rotational angular position on stopping. To avoid such undesirable phenomena, the main let-out roller 75 is rotated in reverse by a small angle after the first bill is let out so as to return the subsequent bill to be let out next to an initial set position.

Furthermore, in the conventional apparatus, the diameter of the main let-out roller 75 is made large in correspondence with the length of a bill so that one bill is let out with a full revolution of the roller 75. As a result, the entire letout apparatus is bulky, and could not be miniaturized.

SUMMARY OF THE INVENTION

It is therefore, an object of the present invention to provide a new and useful paper let-out apparatus which is capable of letting out paper one by one accurately.

According to the present invention there is provided a paper let-out apparatus, comprising: a paper accommodating section for accommodating paper sheets in superimposed condition; a receiving plate forming a wall at one side of the paper accommodating section and formed with a window opened in a part of the receiving plate; a pushing member forming a wall at the other side of the paper accommodating section for urging the accommodated paper toward said receiving plate; a let-out roller, disposed outside the paper accommodating section to face the window, for discharging an endmost sheet of paper; and a friction member provided to a part of periphery of the let-out roller to be projected from the periphery and to protrude into inside of the paper accommodating section through the window when the let-out roller is rotated.

According to a feature of the present invention, paper contained in the paper accommodating section is pressed at its one side by the pushing member, and received at the other side by the receiving plate. The let-out roller is disposed so as to face the window formed in the receiving plate. As the let-out roller is driven to rotate, the friction member provided to the periphery of the let-out roller enters the accommodating section through the window to be protruded therein. Thus, the friction member comes into contact with the front or first paper to discharge the same by the frictional force therebetween.

In this way the friction member of the let-out roller protrudes beyond the window by a predetermined distance which is always constant, and thus a constant pressure is applied to the paper with which the friction member comes into contact. Therefore, most suitable contact pressure can be applied to the paper irrespective of different frictional forces due to humidity conditions, degree of fatigue, stain, and undulations the paper. As a result, a stable let-out operation can be achieved without suffering from noneffective let-out, successive let-out or the like. Therefore, delicate and careful adjustment of the pressing force by the pushing member or cleaning and replacement of rollers which have been required hitherto in conventional let-out apparatus are now unnecessary.

Preferably, the paper let-out apparatus comprises a separating roller placed at the outlet of the paper accommodating section and formed with a circular groove on the periphery thereof and a friction roller arranged to face the above-mentioned separation roller and formed with a circular projecting portion facing the above-mentioned circular groove.

Even if two or more sheets of paper are simultaneously let out by the above-mentioned let-out roller, when these sheets of paper pass through the passage between the separation roller and the friction roller, they are separated from one another as they are slightly deformed in a traverse direction by the circular groove and the projected portion of these rollers. Furthermore, as the movement of the second paper is prevented by the contact friction force with the friction roller, only the first paper is let out.

Since this separation roller is exclusively used for separation and since it is not required to have a let-out function, in other words, since the separation roller is required to cause the first paper to be slid along the periphery of the separation roller, the rotational speed thereof is not required to be equal to that of the let-out roller. Thus, the rotation control of the separation roller is easy, while a smaller roller can be used.

Furthermore, a successive let-out preventing member is preferably provided to the receiving plate. As the front or first paper is moved a little bit by the let-out roller, a subsequent or second paper comes into contact with the let-out preventing member to be stopped by the frictional force therebetween. As a result, the second paper is prevented from being let out together with the first or front paper.

Furthermore, a positioning means for controlling the rotational angular position of the let-out roller is provided so that the friction member attached thereto is placed in a standby position other than at the window when let-out of a single paper is completed. With this provision the friction member stands by at a place outside the accommodating section, and therefore, a subsequent paper sheet is prevented form being caught by the friction member to effectively avoid successive let-out or jam of the paper.

BRIEF DESCRIPTION OF THE DRAWINGS

The objects and features of the present invention will become more readily apparent form the following detailed description taken in conjunction with the accompanying drawings in which.

The same or corresponding elements or parts are designated by like references throughout the drawings.

DETAILED DESCRIPTION OF A PREFERRED EMBODIMENT

The invention will now be described in connection with a preferred embodiment which is a bill let-out apparatus.

A bill let-out apparatus which will be described with reference to the drawings hereinafter is built in a bank transaction machine such as an automatic deposit and payment machine. In such a bank transaction machine, the bill let-out apparatus according to the present invention is used, for instance, for letting out bills one by one for discharging bills contained in a bill containing box, or for letting out bills one by one for taking bills placed or inserted into a bill inlet.

Figure 1:
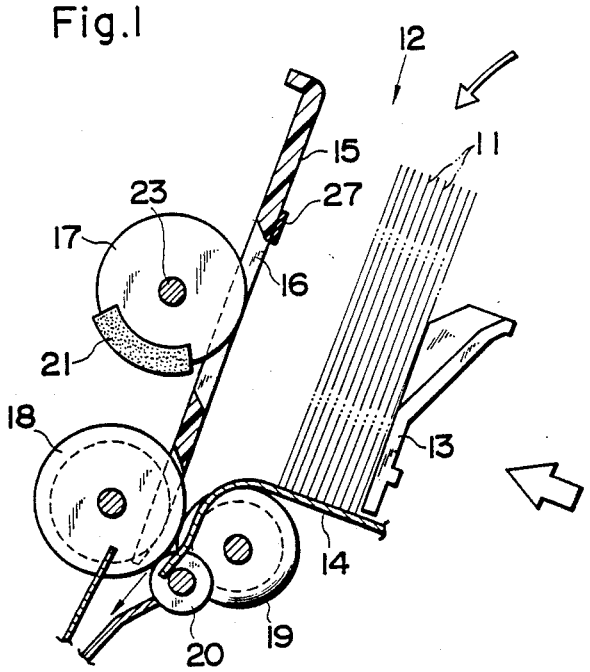
FIG. 1 is a cross-sectional view of an embodiment of the bill let-out apparatus according to the present invention.

Referring to FIG. 1, a cross-sectional view of a bill inserting inlet and a bill let-out apparatus provided therefor is shown. A bill inlet 12 comprises a bottom plate 14, a fixed receiving plate 15 forming one side wall, and a slidable pushing plate 13 positioned opposite to the receiving plate 15 to form another wall. This bill inlet 12 corresponds to a paper accommodating section. Within this bill inlet 12, bills 11 are held in a state such that bills 11 are slightly inclined from a vertically standing state. As shown in FIG. 1, the pushing plate 13 is positioned at a rearmost place to provide the largest capacity of the inside of the bill inlet 12 so that bills can be placed therein. When letting out the bills placed in bill inlet 12, the pushing plate 13 is urged toward the receiving plate 15 by means of a spring or other mechanism to press the bills 11 in the same direction.

Figure 2:
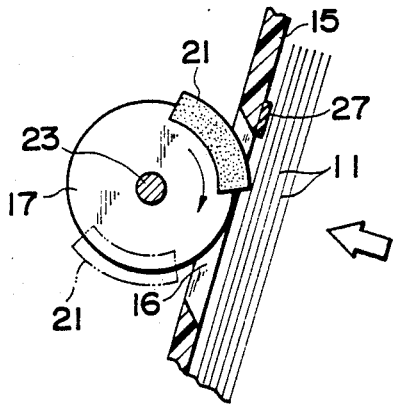
FIG. 2 is a cross-sectional view showing a bill let-out state by a let-out roller of the apparatus shown in FIG. 1.

The receiving plate 15 is formed with windows 16. Let-out rollers 17 are fixed to a rotary shaft 23 outside the bill inlet 12 to face the windows 16, respectively. The peripheries of the let-out rollers 17 do not project into the inside of the bill inlet 12 through the windows 16. Attached to the periphery of each of the let-out rollers 17 is a friction member 21 having a high friction coefficient over a predetermined angle. The friction member 21 may be made of rubber or the like, and projects outward radially from the periphery of the let-out roller 17. Therefore, when the let-out rollers 17 are rotated by a rotational driving mechanism (not shown), the friction members 21 protrude into the inside of the bill inlet 12 through the windows 16. As the let-out rollers 17 rotate as indicated by an arrow in FIG. 2, the front or first bill among plural bills depressed by the pushing plate 13 toward the receiving plate 15 is moved downwardly to be discharged due to the friction force between the first bill and the friction members 21.

Attached to the receiving plate 15, at a place above the windows 16, is a successive let-out preventing member 27 made of a material, such as rubber, having a high friction coefficient. As described above, when the front bill is moved downwardly slightly by the let-out rollers 17 having the friction members 21, an upper portion of the subsequent bill (the second bill) comes into contact with the successive let-out preventing member 27 to be kept stationary by the frictional force therebetween. Thus, the subsequent or second bill is effectively prevented from being discharged together with the front or first bill. The thickness of the successive let-out preventing member 27 may be determined so that the upper portion of the front bill separates from the seccessive let-out preventing member 27 when the friction members 21 come into contact with the front bill to push the front bill toward the pushing plate 13 with the rotation of the let-out rollers 17. More specifically, the thickness of the successive let-out preventing member 27 is preferably thinner than that of the friction members 21.

A portion of the low part of the bill inlet 12 is a bill discharge port or let-out port, and separation rollers 18, friction rollers 19 and pinch rollers 20 are provided around the let-out port. The separation rollers 18 and the friction rollers 19 are used for separating the front or first bill from the bills when two or more bills are erroneously let out from the bill inlet 12 and for discharging only the front or first bill to a next stage. The pinch rollers 20 are in contact with the separation rollers 18 to feed the discharged single bill to a conveying path.

The let-out rollers 17 are controlled to stop at a predetermined rotational angular position whenever let out operation of a single bill is completed. More specifically, at this angular position of the rollers 17 the friction members 21 are located outside the bill inlet 12 as shown by solid line in FIG. 1 and by dot-dash line in FIG. 2. This position is referred to as standby position.

Figure 3:
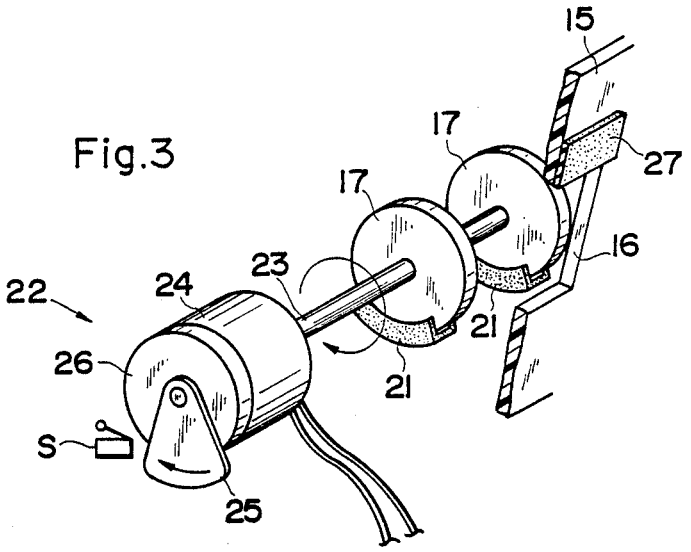
FIG. 3 is a perspective view of a positioning mechanism of the apparatus shown in FIG. 1.

FIG. 3 shows an example of a positioning mechanism which determines the above-mentioned rotational angular position of the let-out rollers 17. The rotary shaft 23 of the let-out rollers 17 is coupled with a solenoid brake 24 having a brake wheel 26. A rotational angular position detecting cam 25 is also attached to the rotary shaft 23. When the position of the cam 25 is detected by a sensor S, such as a limit switch or photoelectric sensor, a control circuit (not shown) responsive to a detection signal from the sensor S generates a brake signal which is fed to the solenoid brake 24 in turn to stop the let-out rollers 17 at the above-mentioned standby position. A motor (not shown) for driving the rotary shaft 23 is deenergized simultaneously.

Figure 4:
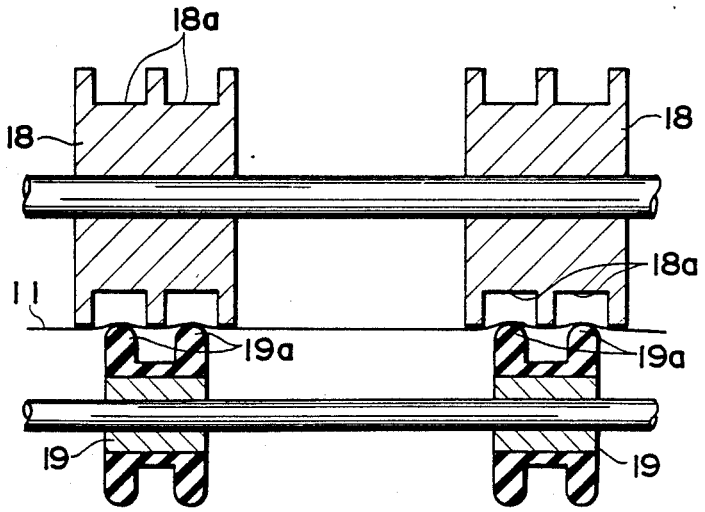
FIG. 4 is an enlarged cross-sectional view of a separation roller and a friction roller both included in the apparatus of FIG. 1.

FIG. 4 shows the relationship between the separation rollers 18 and the friction rollers 19 shown in FIG. 1. Each of the separation rollers 18 are formed with circular grooves 18*a* so that the peripheral surface is concave and convex axially. On the other hand, each of the friction rollers 19 has circular projections 19*a* on its periphery such that the peripheral surface thereof is concave and convex axially in a manner similar to the separation rollers 18. When a bill 11 discharged by the friction members 21 passes through the passage between the rollers 18 and 19, the bill 11 is slightly deformed to be undulatory due to the concave and convex shape of the peripheral surfaces of the rollers 18 and 19. With this operation, two or more superimposed bills are separated from each other.

The peripheral surface of the separation roller 18 preferably has a smaller friction coefficient so that a bill contacting the same can slip easily. Thus, the front bill let out by the let-out rollers 17 slides along the passage between the separation rollers 18 and the friction rollers 19. Since the separation roller 18 has no friction member on its periphery, the diameter thereof may be made small so that this roller is used for separation exclusively. Using such a small-diameter separation roller 18 is very advantageous for miniaturization of the let-out apparatus.

On the contrary, the peripheral surfaces of the friction roller 19 and pinch roller 20 are made of a material, such as rubber, having a high friction coefficient. To the rotary shaft of the friction rollers 19 may be provided a one-way clutch which restricts rotation in the let-out direction and allows rotation in the opposite direction. With this provision, the second bill moved together with the first bill is prevented from being moved further down.

Figure 5:
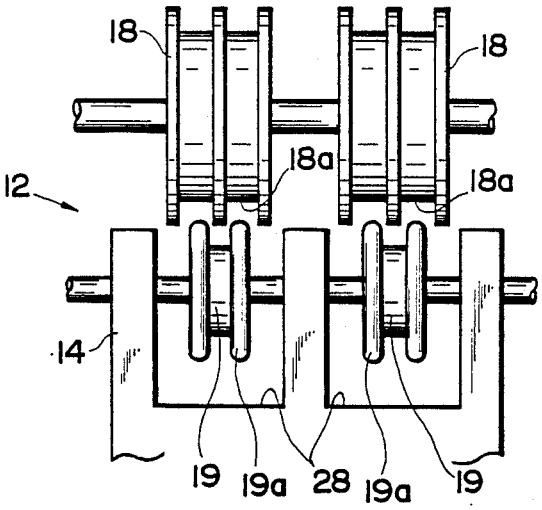
FIG. 5 is a plane view of a bottom plate of a bill inlet of the apparatus shown in FIG. 1
Figure 6:
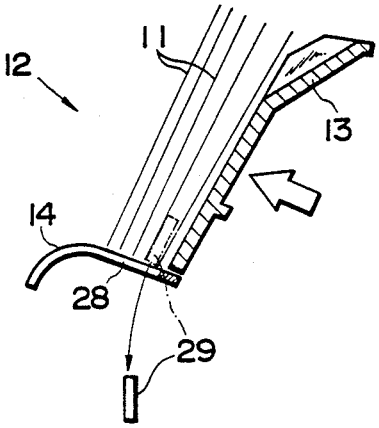
FIG. 6 is a cross-sectional view showing a state in which a foreign object is dropped.
Figure 7:
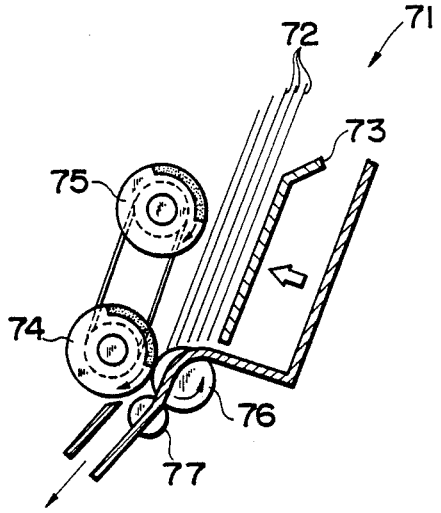
Fig. 7 PRIOR ART
FIG. 7 is a cross-sectional view showing a conventional paper let-out apparatus.

As shown in FIG. 5, in the bottom plate 14 of the bill inlet 12 is formed a foreign object dropping opening 28 defined by a comb-like configuration where each element of the comb extends in a direction in which the bills are pressed. When plural bills 11 in a bundle are put in the bill inlet 12 as shown in FIG. 6, a foreign object 29, such as a coin, erroneously dropped into the bill inlet 12 together with the bills 11 can be dropped to a lower portion as indicated by an arrow through the foreign object dropping opening 28 to remove the same. Therefore, invasion of such a foreign object into a further inner portion of the bank transaction machine is prevented.

The above described bill let-out apparatus of FIGS. 1 to 6 operates as follows. As the bills placed in the bill inlet 12 are pressed toward the receiving plate 15 by the pressing force from the pushing plate 13, a driving system, including the let-out rollers 17 and the separation rollers 18, is driven in accordance with a let-out command signal. With the rotation of the rollers 17 and 18 in the let-out direction, and with the friction members 21 of the let-out rollers 17 protruding beyond the windows 16 into the inside of the bill inlet 12 to be in contact with the front bill 11, the front bill 11 is securely drawn in the let-out direction by the let-out rotational force of the let-out rollers 17. As the friction members 21 give a great frictional force to the bill 11, noneffective let-out is prevented. Furthermore, bills 11 are let out one by one to be fed to a following stage after being subjected to a separation function by the separation rollers 18 and the friction rollers 19 facing each other.

When a subsequent or second bill is almost let out due to humidity conditions, fatigue, undulatory surface, close contact between bill the upper portion of the second bill comes into contact with the successive let-out preventing member 27 to be kept stationary. When let-out of a single bill is completed, the let-out rollers 17 are stopped such that the friction members 21 are at the standby position which is outside the bill inlet 12 to be prepared for letting out a subsequent bill.

As described above, since the friction member 21 of the let-out roller 17 is arranged to enter and go out of the bill inlet 12 used as paper accommodating section through the window 17 made in the receiving plate 15, the friction members 21 protrude beyond the window 16 by a predetermined distance to give a constant pressure to the front bill which is in contact therewith. For this reason, although different frictional forces are applied to bills due to humidity conditions, fatigue, stain, undulations and so on of bills, a stable let-out performance is obtained in which noneffective let-out or successive let-out is securely prevented. Therefore, delicate and careful adjustment of the pressing force of the pushing plate and frequent cleaning or replacement of rollers are not required.

Furthermore, since it is possible to arrange that the roller positioned downstream in the let-out flow is a roller used for separation exclusively without having any let-out or discharging function, a small diameter roller can be employed to miniaturize the let-out apparatus and to reduce the cost thereof.

Moreover, as it is possible to control the let-out roller so that the friction member attached thereto is placed at a standby position outside the bill accommodating section using the positioning mechanism, undesirable catching of a subsequent bill is prevented so that seccessive let-out or occurrence of jamming can be reliably prevented.

What is claimed is:

1. A paper let-out apparatus, comprising:

(a) a paper accommodating section for accommodating paper sheets in superimposed condition;

(b) a receiving plate forming a wall at one side of said paper accommodating section and formed with a window opened in a part of said receiving plate;

(c) a pushing member forming a wall at the other side of said paper accommodating section for urging said accommodated paper toward said receiving plate;

(d) a let-out roller, disposed outside said paper accommodating section to face said window, for discharging an endmost sheet of paper;

(e) a friction member provided to a part of a periphery of said let-out roller to project from said periphery and to protrude inside said paper accommodating section through said window when said let-out roller is rotated;

(f) a separation roller disposed near a let-out port of said paper accommodating section and comprising a peripheral surface having a first coefficient of friction with a magnitude to facilitate slippage of paper contacting therewith; and (g) a friction roller disposed in facing relationship with said separation roller and comprising a peripheral surface having a second coefficient of friction with a magnitude greater than that of said first coefficient of friction.

2. A paper let-out apparatus as in claim 1, wherein said separation roller is formed with a circular groove in said peripheral surface thereof and said friction roller is formed with a circular projection in said peripheral surface thereof, said circular projection facing said circular groove.

3. A paper let-out apparatus as in claim 1, further comprising a successive let-out preventing member attached to said receiving plate, said seccessive let-out preventing member being arranged to provide a frictional force to a second paper sheet which is subsequently positioned with respect to an endmost paper sheet being discharged.

4. A paper let-out apparatus as in claim 1, wherein said paper accommodating section is arranged to hold said paper such that said paper is slightly inclined from a vertically standing state, and has a bottom plate for supporting said paper contained therein, said bottom plate being formed with an opening for allowing a foreign object to drop therethrough.

5. A paper let-out apparatus as in claim 1, further comprising positioning means for controlling an angular position of said let-out roller so that said friction member is located outside said paper accommodating section when discharge of one paper sheet is completed.

* * * * *